United States Patent [19]

Kasschau

[11] 4,388,070

[45] Jun. 14, 1983

[54] PROPELLER EXHAUST HUB AND SHROUD

[76] Inventor: Kenneth Kasschau, 17620 Garrett Dr., Gaithersburg, Md. 20760

[21] Appl. No.: 971,551

[22] Filed: Dec. 20, 1978

[51] Int. Cl.[3] ..... B63H 1/20

[52] U.S. Cl. ..... 440/89; 416/93 A; 416/193 R

[58] Field of Search ..... 416/93 R, 93 A, 93 M, 416/94, 189, 193 R; 440/89

[56] References Cited

U.S. PATENT DOCUMENTS

| | | | |
|---|---|---|---|
| 573,351 | 12/1896 | Parker | 440/67 |
| 2,948,252 | 8/1960 | Alexander | 115/34 R |
| 3,356,151 | 12/1967 | Strang | 416/9 M |
| 3,554,665 | 12/1971 | Lorenz | 416/93 A |
| 3,576,172 | 4/1971 | Ward | 115/73 |
| 3,764,228 | 10/1973 | Shook | 416/93 A |
| 3,871,324 | 3/1975 | Kasschau | 440/89 |
| 4,276,036 | 6/1981 | Nishida | 440/89 |

*Primary Examiner*—Sherman D. Basinger

*Attorney, Agent, or Firm*—Fidelman, Wolffe & Waldron

[57] ABSTRACT

A propeller for controlling the discharge of gases and cooling water exhausting from the central hub of an outboard motor unit comprising a cylindrical shroud surrounding the propeller hub to confine the exhaust to the inner most part of the blades and discharge it downstream of the propeller when operating the unit in the forward or reverse mode. Several attachments to this shroud which enhance the discharge performance of the propeller are disclosed. An alternate embodiment comprises a shroud which may be attached to a conventional through-hub marine propulsion device to channel the exhaust away from the propeller area.

4 Claims, 7 Drawing Figures

PROPELLER EXHAUST HUB AND SHROUD

This invention relates to a propeller with a shrouded exhaust hub structure for a marine propulsion device and accessories thereto. Additionally, the invention contemplates an alternative flow control unit which can be attached to conventional marine units to channel the exhaust away from the propeller area.

BACKGROUND OF THE INVENTION

Most modern outboard marine propulsion devices discharge exhaust gases and cooling water below the surface of the water. This design is particularly effective for preventing the obnoxious exhaust gases from travelling to the cockpit area of the vessel and disturbing passengers or crew members. Additionally, exhausting below the surface of the water serves to muffle the noise of the motor.

Many of these below-surface units discharge engine exhaust gases admixed with cooling water to the rear of the propeller area through the propeller hub. A principal benefit of this practice is that while the boat is in forward motion the fluid flow through the propeller is of uniform density (i.e., the water is not disrupted by bubbles of exhaust gas and the gases permit minimum negative pressure in the region of the hub). This advantage is achieved at some sacrifice to operation in the astern mode, wherein the exhaust gases are discharged upstream of the propeller and mix with the water flowing through the propeller area. The substantial decrease in density due to the bubbles reduces the reverse thrust capacity of the propulsion unit.

Several earlier attempts have been made to solve this problem of "cavitation" caused by the discharge of exhaust gases into the water through which the propeller is biting (i.e., upstream of the propeller). One such solution is presented in U.S. Pat. No. 3,467,051 which provides a marine propulsion lower unit having a means for axially shifting the propeller relative to the lower unit of the device. This axial shift of the propeller when the unit is in the reverse mode provides an opening downstream of the propeller through which exhaust gases discharge.

There are several disadvantages to the solution proposed in the patent. First, it is necessary to have a means for axially shifting the position of the propeller relative to the lower unit, thus requiring additional construction costs and efforts. Second, the proposed solution cannot readily be used to retrofit propulsion devices currently in use. Finally, the unit as designed could encounter serious fouling and plugging problems, particularly from vegetation which may become entangled around the propeller shaft which is exposed during reverse mode operation.

SUMMARY OF THE INVENTION

The present invention relates to a propeller and accessory structures for fluids control to achieve uniform fluid (water) flow through essentially the entire propeller area when going astern, thereby providing substantially increased reverse thrust at little or no expense to forward performance.

In one embodiment of the invention a cylindrical shroud surrounds the propeller hub to confine exhaust gases and cooling water discharge to the innermost portion of the propeller when going either astern or forward. Thus, essentially the entire blade area operates in an undisturbed water environment to develop full thrust capability in either direction.

This simple and inexpensive solution avoids the problems inherent in structures proposed in the prior art. It requires no structural or mechanical modification to the lower unit of marine propulsion devices, it may be used to retrofit any through-hub exhaust propulsion devices currently in use, there is no need for axial movement of the propeller, and the danger of fouling and plugging is significantly reduced.

Another embodiment of the present invention comprises a shroud independent of a propeller which may be used to retrofit existing propellers to achieve the advantages of the invention.

OBJECTS OF THE INVENTION

It is an object of this invention to provide a means for exhausting gases and cooling water downstream of the propeller when operating the marine propulsion device to which it is connected in either the forward or reverse mode.

It is another object of this invention to provide a propeller suitable for use on conventional through-hub exhaust marine propulsion devices which exhausts gases and cooling water downstream of the propeller when operating the device in the forward or reverse mode.

It is still another object to provide a propeller suitable for retrofitting marine propulsion devices currently in use to achieve the above-described objects.

It is a further object of this invention to provide a shroud suitable for retrofitting propellers currently in use to achieve the above-described objects.

Other objects, features and advantages of the invention may be understood with reference to the following detailed description and the appended drawings in which.

DETAILED DESCRIPTION OF THE INVENTION

Figure 1:
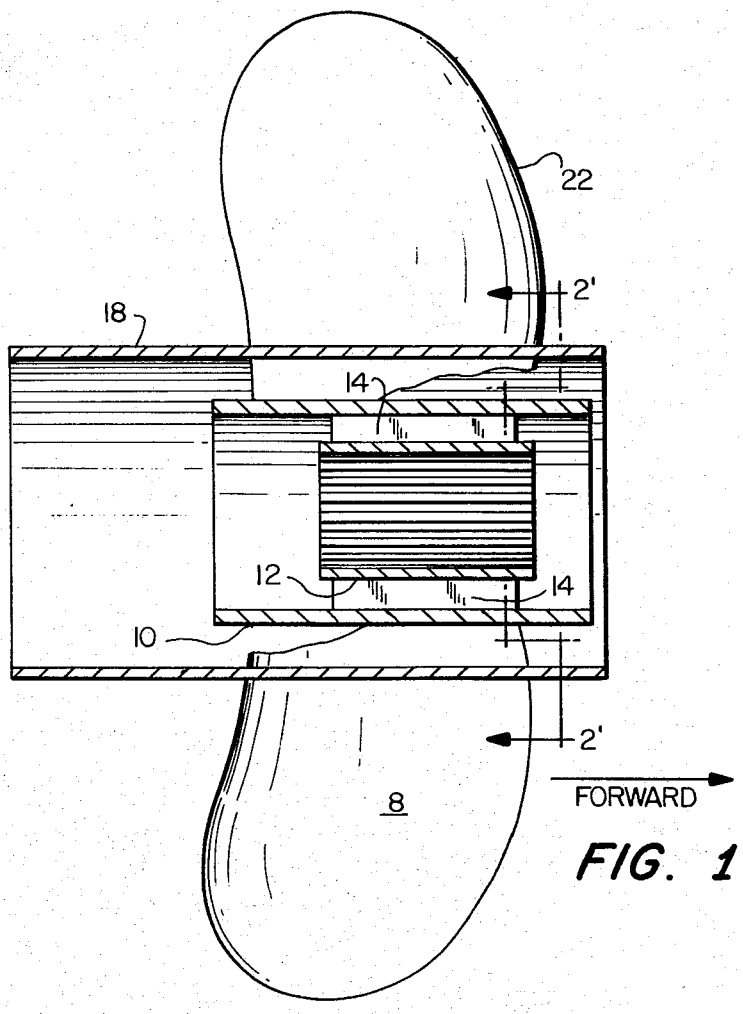
FIG. 1 is a side cross-sectional view through the center of a propeller hub equipped with the shroud of the invention.
Figure 2:
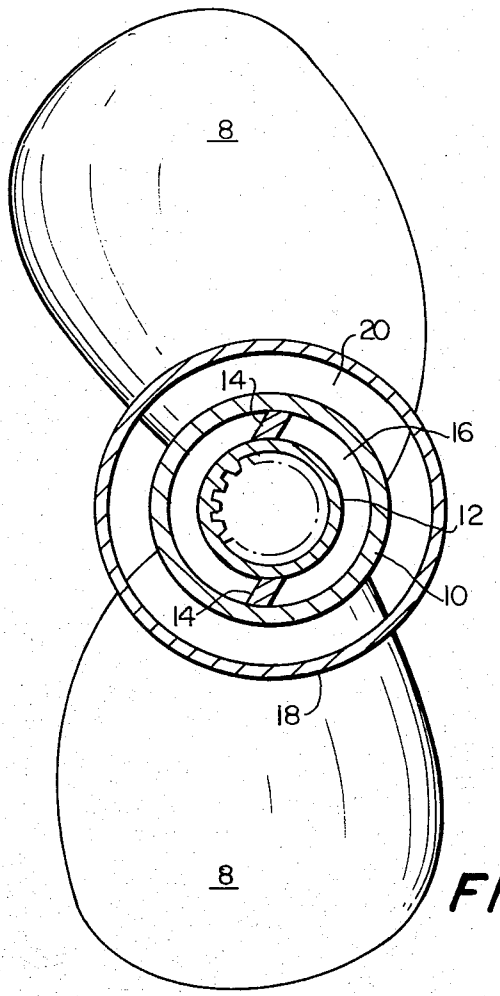
FIG. 2 is a cross-sectional view of the propeller hub of FIG. 1 taken through section line 2'—2'.

FIG. 1 shows a modified propeller design in which the blades 8 are supported by a hub 10 drivably attached through members 14 to a splined inner sleeve 12 for drivable attachment to the propeller shaft (not shown). The annular gap 16 (see FIG. 2) between the hub 10 and the splined sleeve 12 is the passage through which exhaust gases and cooling water flow. It can be seen that without further provision the exhaust gases would be discharged astern propeller when the unit is in forward motion or in astern motion. That is to say, the exhaust gases are channeled away from the area of water into which the propeller is biting only in the forward operation.

The present invention incorporates a cylindrical shroud 18 surrounding the hub 10. In one embodiment the shroud is radially spaced from the hub such that the area of the annulus 20 thus formed is approximately the same as the area of the annulus 16. In the forward mode exhaust gases and cooling water are discharged rearward from the hub 10 and water flows through annulus 20 as would occur with a conventional, unshrouded propeller. When the unit is going astern the rearward extension of the shroud 18 confines the exhaust gases to the area encompassed by the shroud 18 and the flow of ambient water from the rear toward the front induced by propeller action and boat motion reverses the flow of exhaust gases causing them to pass through annulus 20 toward the forward face 22 of the propeller 8 at which point it is discharged to the surroundings downstream of the propeller area. Thus, only the innermost fraction of the blade (that within the shroud 18) is perturbed by the gas/water mixture of low density. The major part of the blade area operates in the undisturbed body of ambient water exterior to the shroud. It should be noted that the portion of the blade within the shroud need not be continuous with the portion of the blade immediately exterior to the shroud. Optimum flow considerations within the shroud may dictate certain modifications to the blade angle and configuration within the shroud.

Figure 3:
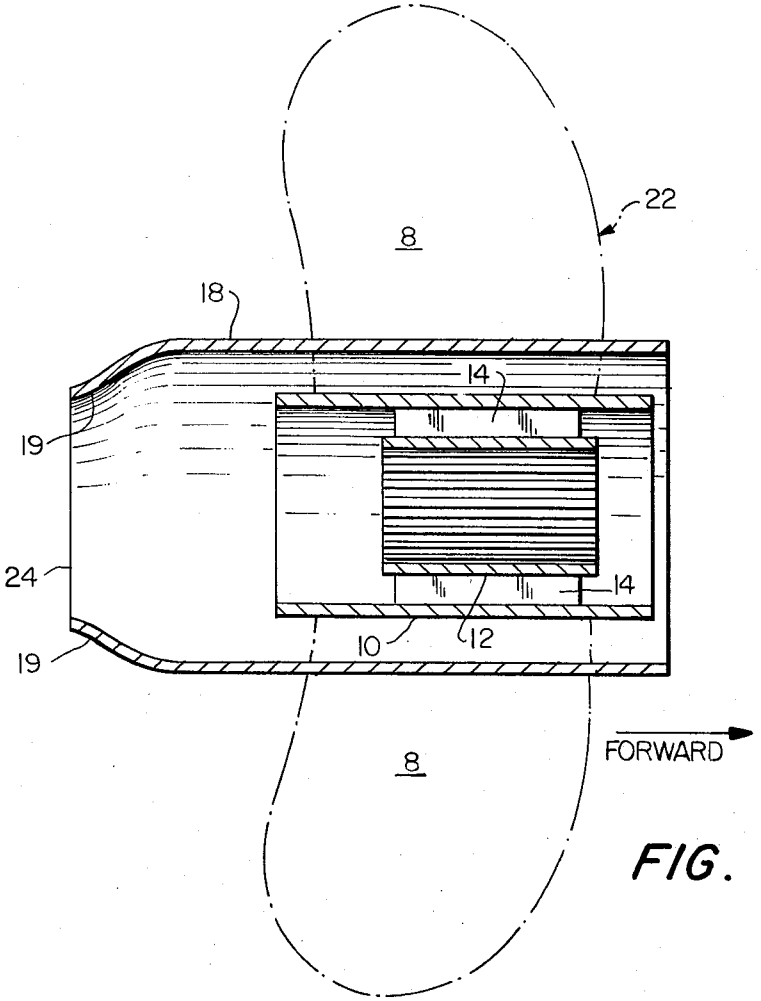
FIG. 3 is a side cross-sectional view through the center of a propeller hub equipped with the shroud and a shroud extension of the invention.

A refinement to the shroud is shown in FIG. 3 as an extension 19 to the rearward of shroud 18. The reduced cross-sectional area of the opening 24 causes the incoming ambient water to diffuse and redirect the gas, flowing astern from annulus 16, into the annulus 20 and toward the bow when operating the unit in the astern mode.

Figure 4:
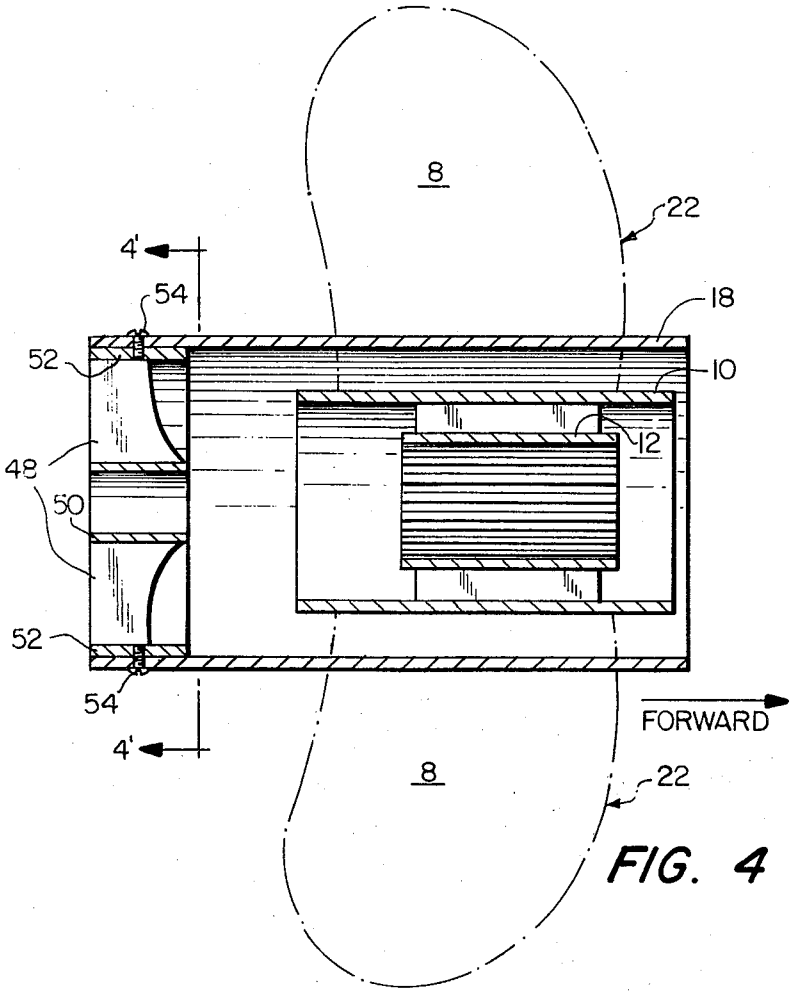
FIG. 4 is a side cross-sectional view through the center of a propeller hub equipped with a flow inducer of the invention.
Figure 5:
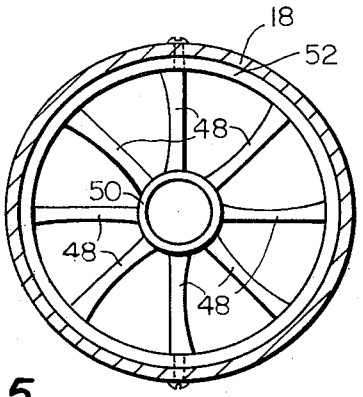
FIG. 5 is a cross-sectional view of the exhaust shroud and flow inducer of FIG. 4 taken through section line 4'—4'.

An alternate refinement is shown in FIGS. 4 and 5 in which a flow inducer is positioned at the rear of the exhaust gas shroud 18. The inducer assembly is comprised of a plurality of vanes 48 supported at their inner radius by sleeve 50 and at their outer radius by sleeve 52 and fitted within and attached to the shroud 18 as by screws 54. Any means for attaching the flow inducer to the shroud will suffice, including soldering, molding, casting, bonding, interlocking, etc. Because it is necessary to provide for access to the propeller retaining nut (not shown), it is ordinarily preferable that the inducer be detachable from the shroud. The vanes are so disposed as to induce the flow of water in the same direction as the propeller blades. It will be seen that in forward motion the vanes will introduce little or no obstruction to the rearward discharge of the exhaust gases, whereas in the astern mode the vanes can substantially enhance the natural flow of ambient water and assist in the reversal of exhaust gas flow to cause discharge at the face 22 of the propeller 8.

Figure 7:
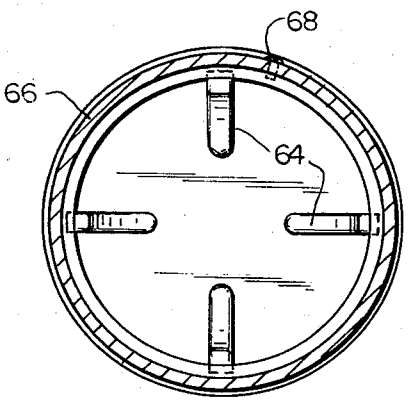
FIG. 7 is a cross-sectional view of the exhaust shroud and valve of FIG. 6 taken through section line 6'—6'.
Figure 6:
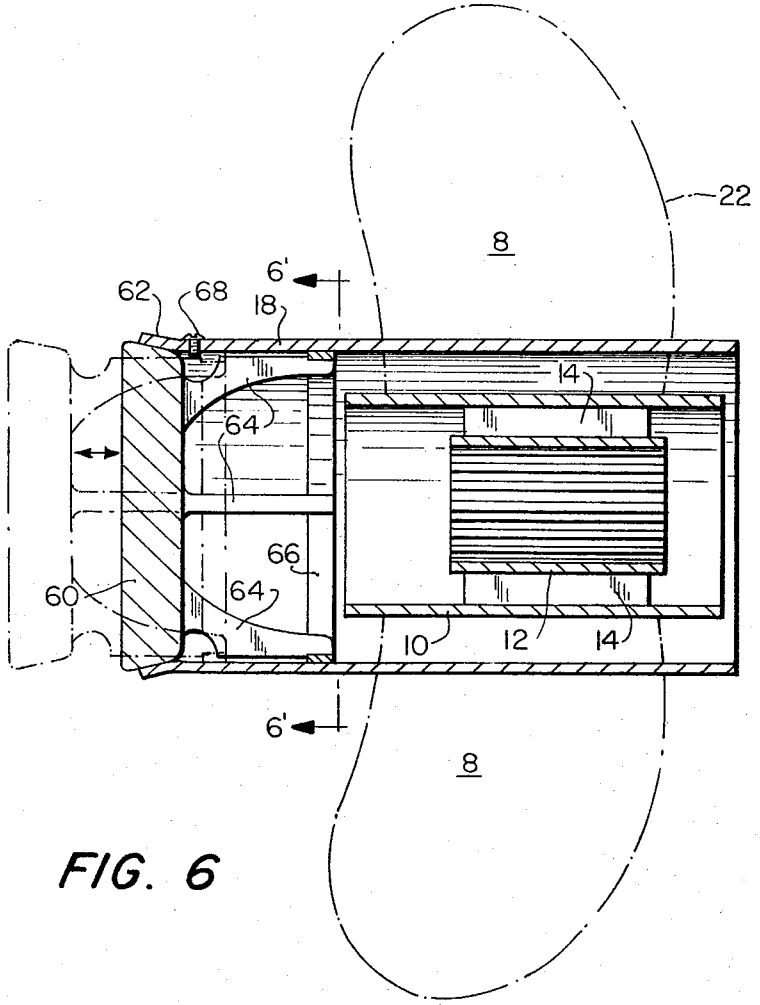
FIG. 6 is a side cross-sectional view through the center of a propeller hub equipped with a valve on the rearward end of the shroud of FIG. 1.

A third refinement is shown in FIGS. 6 and 7 in which a valve 60 is inserted in the after end of the shroud 18 so as to be axially slidable within the shroud. In the astern mode valve 60 is urged forward into contact with the after end of shroud 18 which has a slight conical extension 62 to cooperate with valve 60 in forming a reasonably tight seal. The valve 60 is maintained concentric with the shroud 18 and seat 62 by guides 64 which are encircled at their forward ends by a ring 66 which supports the guides 64 and also serves as a travel limiter (in the rearward direction) for the valve 60 by engagement with the travel stop 68.

It can be seen that when the unit is in forward motion the valve 60 is free to move aft, opening the inside of shroud 18 to permit rearward flow of fluids. In the astern mode of operation the pressure generated by relative ambient waterflow effectively closes the after end of the shroud 18, thus ensuring reversal of the flow of exhaust gas and cooling water and providing for discharge of both fluids at or near the forward face 22 of the propeller 8.

What is claimed is:

1. A propeller for a through-hub exhaust marine propulsion device, comprising: a hub having a passageway through which exhaust gases flow to rearward, at least one propeller blade, and an annular shroud means extending rearwardly past the after termination of the hub and forward to the forward edge of said blade and fixed concentrically around said hub and open on each end, and means for preventing discharge of exhaust gas through the rearward opening of said shroud means when the said propeller operating in the reverse mode, comprising inducer means for positively inducing the flow of ambient water into said shroud through the rearward opening when the propeller is operating in the reverse mode.

2. The propeller of claim 1 wherein said inducer means comprises a fully shrouded propeller means within the said shroud means at the said rearward opening thereof.

3. A shroud for attachment to a propeller of a marine propulsion device, said propeller operable in forward and reverse modes and having at least one blade with a forward face and a rearward face and a hub through which exhaust gases are exited toward said rearward face during said forward mode of operation, said shroud comprising:

tubular means, spaced from said hub and having a forward opening and a rearward opening, for redirecting said exhaust gases exiting from said hub toward said forward face to reduce cavitation at said rearward face during said reverse mode of operation, said shroud extending to the rearward of said hub and to the vicinity of said forward face, and means for preventing discharge of exhaust gas through the rearward opening when the propeller is operating in the reverse mode, comprising inducer means for positively inducing the flow of ambient water into said shroud through the rearward opening when the propeller is operating in the reverse mode.

4. The shroud means of claim 3 wherein said inducer means comprises a fully shrouded propeller means within the said shroud means at the said rearward opening thereof.

* * * * *